US005937481A

United States Patent [19]

Faringosi

[11] Patent Number: 5,937,481

[45] Date of Patent: Aug. 17, 1999

[54] HINGE FOR FURNITURE AND THE LIKE, WITH MOVABLE ARM ARRANGED INSIDE THE FIXED ARM

[75] Inventor: Alvaro Faringosi, Milan, Italy

[73] Assignee: Faringosi Hinges S.R.L., Milan, Italy

[21] Appl. No.: 08/902,675

[22] Filed: Jul. 30, 1997

[30] Foreign Application Priority Data

Apr. 18, 1997 [IT] Italy ..... M1970278 U

[51] Int. Cl.[6] ..... E05D 11/10

[52] U.S. Cl. ..... 16/332; 16/334; 16/327; 16/82; 16/292; 16/352; 126/191

[58] Field of Search ..... 16/328, 329, 330–334, 16/352, 353, 371, 374, 312–314, 292, 299, 300, 343, 344, 345, 324, 86 C, 82; 126/191, 194

[56] References Cited

U.S. PATENT DOCUMENTS 1,238,871 9/1917 Bartran .
2,064,839 12/1936 Kroll et al. .
2,721,547 10/1955 Pollock .
3,123,064 3/1964 Hartson ..... 126/191
4,174,550 11/1979 Hurst, Jr. .
4,380,848 4/1983 Guionie et al. .
4,658,474 4/1987 Anderssen .
5,291,634 3/1994 Zanetti .

FOREIGN PATENT DOCUMENTS 0738817 10/1996 European Pat. Off. ..... E05F 1/12

*Primary Examiner*—Chuck Y. Mah
*Attorney, Agent, or Firm*—Ladas & Parry

[57] ABSTRACT

Hinge for connecting doors (1*b*) to ovens (1,1*a*) and the like, which comprises a fixed arm (11) engageable with the body of the oven, a movable part (21) which is hinged on said fixed arm (11) and on which one end (23*b*) of a movable arm (23) is pivotably mounted, there being provided means (15) for fastening the movable arm (23) to the fixed arm (11), said fixed arm (11) having a cross-section in the form of an upturned "U", between the walls of which there is arranged an idle roller (25), and said movable arm (23) being arranged inside said fixed arm.

9 Claims, 2 Drawing Sheets

HINGE FOR FURNITURE AND THE LIKE, WITH MOVABLE ARM ARRANGED INSIDE THE FIXED ARM

The present invention relates to a hinge for connecting doors to associated ovens and the like, which comprises a fixed arm engageable with the body of the oven and integral with the movable hinge part fixed to the door, which fixed arm has a cross-section in the form of an upturned "U" which has arranged inside it a movable arm in turn pivotably mounted on said movable hinge part.

It is known in the technical sector relating to the production of hinges for connecting the doors closing ovens, electric household appliances, furniture and the like, of the need for manufacturing said hinges as two parts, one of which is integral with the oven or like and the other integral with the door for closing the same, so that it is possible to arrange the said door in stable positions where it is closed, partially open for ventilating the oven during cooking with the spit, or totally open, as well as in a stable position where it is possible to separate the door, together with its hinge part, from the oven, while ensuring safety conditions which prevent injury to the user.

Hinges designed to solve these problems are known, for example, from IT-174,447 in the name of the same Applicant, which describes a hinge with a fixed pivoting arm for joining door and oven and a movable arm integral with the door and movable with the latter.

While solving the aforementioned technical problem, these hinges have the drawback, however, of leaving the movable arm above the fixed arm with the consequent need for providing special configurations of the said arms designed to prevent trapping of the operator's fingers, this requiring consequent over-dimensioning of the various parts with an obvious increase in the volume, weight and overall costs of the hinge.

In addition to this, the manufacturers require, for aesthetic reasons, that this upper movable arm should not remain visible during partial or total opening of the door.

Hinges are also known, in which this upper movable arm has been eliminated, thus solving the problem relating to the visible presence and extension thereof, but giving rise at the same time to problems relating to balancing and operation of the hinge, resulting in the need to insert inside the body thereof a second hinge, acting under compression, in addition to the conventional spring acting by means of extension in order to counterbalance the weight of the door, thus resulting in a notable increase in the longitudinal dimensions of the hinge itself, but nevertheless not providing any guarantee as regards control of tilting of the door during opening, since no mechanical end-of-travel stops are provided for the opening movement itself.

The technical problem which is posed, therefore, is that of providing a hinge for the doors of ovens, electric household appliances, furniture and the like, which allows said door to be positioned in various stable open positions, allows easy and safe separation of the door from the body of the oven or the like and, at the same time, does not have a movable arm which is visible.

Within the scope of this problem a further need is that said hinge should have limited dimensions, be easy and economical to assemble and applicable also to doors of the known type without particular special adaptations of either part.

These technical problems are solved according to the present invention by a hinge for connecting doors to ovens and the like, which comprises a fixed arm engageable with the body of the oven, a movable part which is hinged on said fixed arm and on which one end of a movable arm is pivotably mounted, there also being provided means for fastening the movable arm to the fixed arm, said fixed arm having a cross-section in the form of an upturned "U", between the walls of which there is arranged an idle roller, and said movable arm being arranged inside said fixed arm.

Further details may be obtained from the following description of a non-limiting example of embodiment of the invention provided with reference to the accompanying figures, in which.

Figure 1:
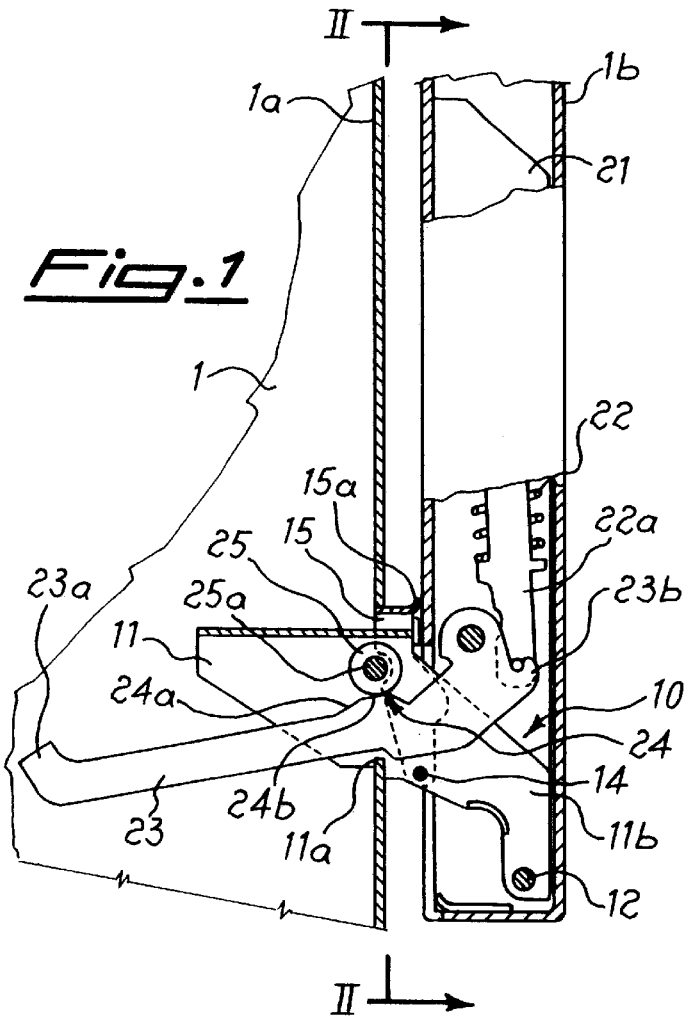
FIG. 1 shows a cross-section along the plane indicated by I—I in FIG. 2 of the hinge according to the invention applied to a door in the closed position of the oven.
Figure 2:
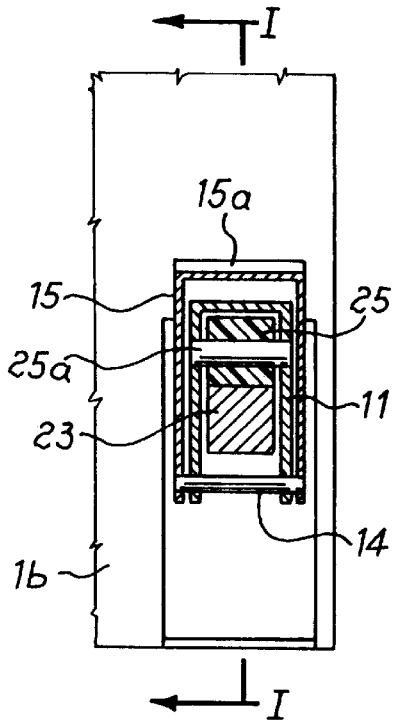
FIG. 2 shows a cross-section along the plane indicated by II—II in FIG. 1.

As illustrated, the hinge according to the invention is arranged between the body 1*a* of an oven 1 and the door 1*b* for closing the same.

The hinge has a fixed part 10 comprising an arm 11 with an elbow bend and a cross-section substantially in the form of an upturned "U"; said arm has in its bottom part a recess 11*a* designed to be coupled with a corresponding projection of the oven wall with which it engages.

At the opposite end 11*b* outside the oven, the arm 11 has a pin 12 with a substantially horizontal axis which forms the axis of rotation of the hinge and on which the body 21 of the movable part of the hinge itself is hinged; said body 21 has a cross-section in the form of a "C" and houses inside it a spring 22 acting under compression on an associated support 22*a* which in turn acts on one end 23*b* of a movable arm 23 rotating on a horizontal idle pin 23*c* arranged between the two walls of the "U".

The other end of the movable arm 23 is free and shaped in the manner of a hook 23*a* designed to engage with a roller 25 mounted idle on a horizontal pin 25*a* arranged inside the fixed arm 11 between the two walls of the "U".

On its upper surface the movable arm 23 also has a relief 24 with inclined sides 24*a*, which is designed to come into contact with said roller 25 so that the interference between the upper surface 24*b* of the relief and the roller 25 produces a predetermined contrasting action such that a certain degree of force is required in order to open the oven door; similarly the contact of the inner side 24*a* against the same roller 25 is designed to cause a braking action of the door in the partially open position for cooking with the spit as described further below with reference to operation of the hinge.

The external bottom surface of the fixed arm 11 (FIG. 5) is also provided with a pin 14 on which one end of lever 15 is hinged, the other end of said lever having a tongue 15*a* designed to be inserted in abutment against a corresponding seat 23*b* of the movable arm 23; as will emerge more clearly further below with reference to operation of the hinge, this lever 15 enables the movable arm 23 to be made integral with the fixed arm 11 for pulling out the door from the oven body.

Figure 3:
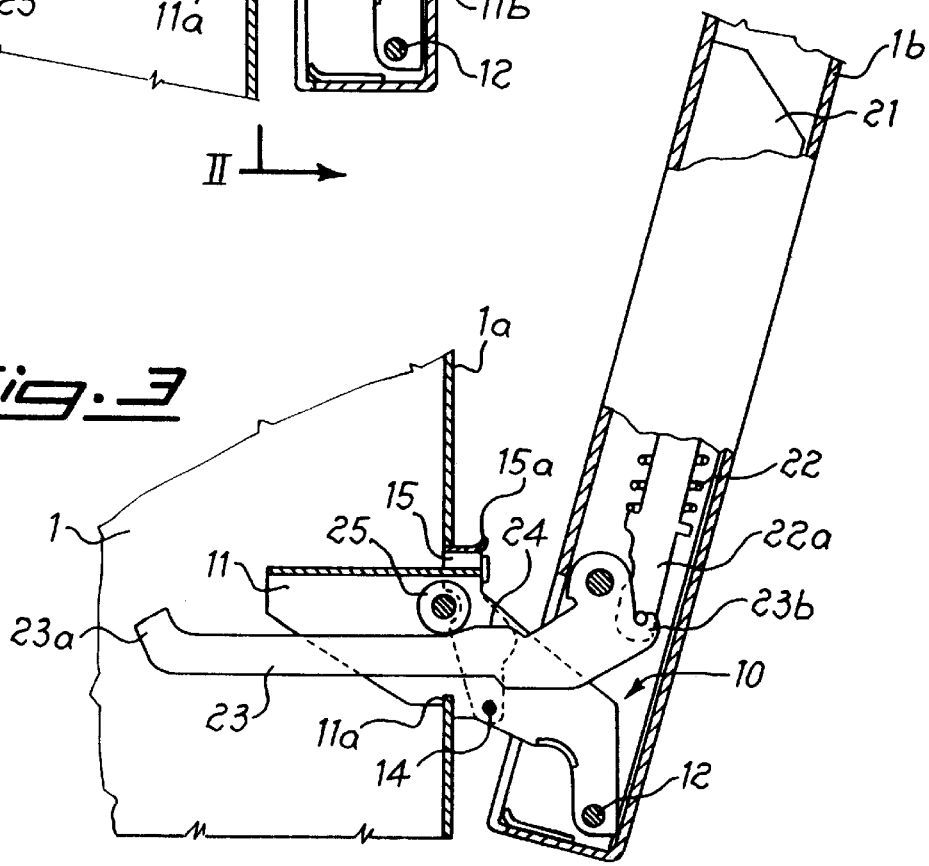
FIG. 3 shows a partially sectioned side view of the hinge according to FIG. 1 in the partially open position.
Figure 4:
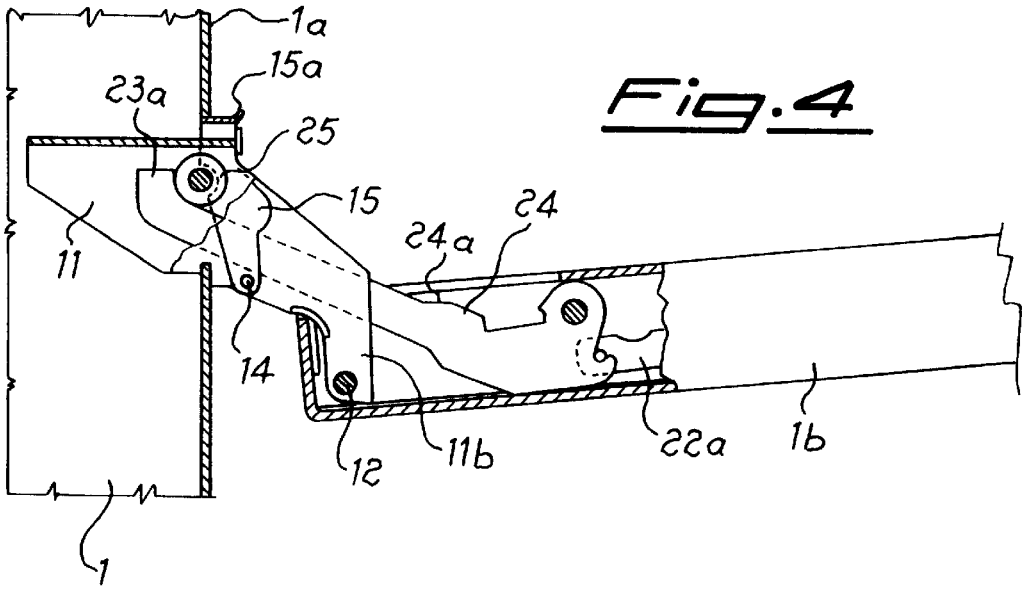
FIG. 4 shows a partially sectioned side view of the hinge according to FIG. 1 in the totally open position.
Figure 5:
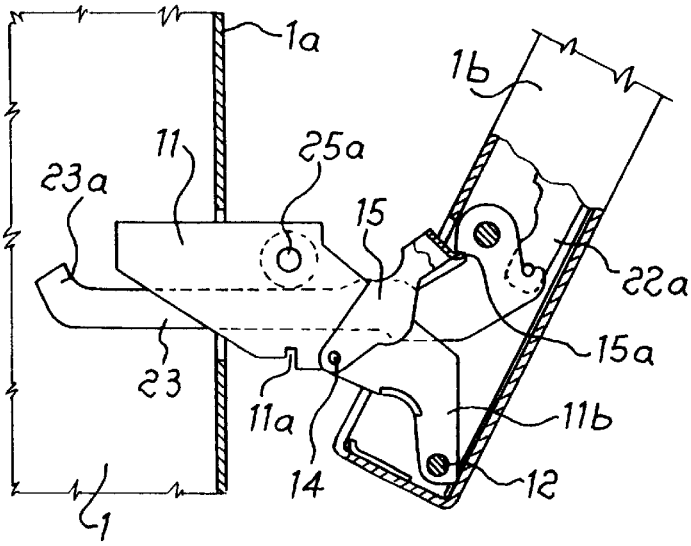
FIG. 5 shows a partially sectioned side view of the hinge according to FIG. 1 in the position pulled out from the oven body.

Operation of the hinge is as follows:

when the door 1*b* is in the closed condition (FIG. 1), the particular configuration of the relief 24 of the arm 23 ensures the necessary force for pushing the door against the contact seal of the oven so that no heat escapes from the oven;

by partially opening the door 1*a* (FIG. 3) it is possible to bring the movable arm 23 into a position such that the roller 25 rests on the internal side 24*a* of the projection 24, counterbalancing the thrusting force component of the spring 22 and thus keeping the partially open position of the door stable, which is particularly useful in the case of cooking with the spit;

when the door 1*b* is fully opened (FIG. 4), the movable arm 23 brings its free hook-shaped end 23*a* against the roller 25, thus acting as an end-of-travel safety stop against tilting of the door itself;

finally, as illustrated in FIG. 5, it is possible to open the door at a suitable angle which allows the operator to rotate the lever 15 in a clockwise direction so as to engage the tongue 15*a* into the seat 23*b* of the movable lever 23 and cause fastening of the movable arm itself with the fixed arm 11; in this condition it is therefore possible to separate the door 1*b* from the body 1*a* of the oven since the fixed arm may be disengaged from its anchoring seat and pulled out integrally with the movable arm without the risk of sudden movements of the hinge due to the spring 22 and prevented by the opposing action of the lever 15.

It is therefore obvious how the hinge according to the invention allows perfect and complete operation of a hinge with a movable arm to be maintained, ensuring a uniform and and reliable closing action of the door over time, balanced opening and control of the tilting movement of the door, but without the movable arm being visible and without the dimensions of the hinge being altered, thereby making it possible to use the hinge according to the invention in place of hinges of the conventional type, without the need for substantial variations of the various component parts and the walls of the oven and the door.

In addition to this, it is also possible to eliminate the roller support element which, in conventional hinges, consisted of an additional body to be fastened to the body of the oven, while in the present invention it is an integral part of the hinge.

Figure 6:
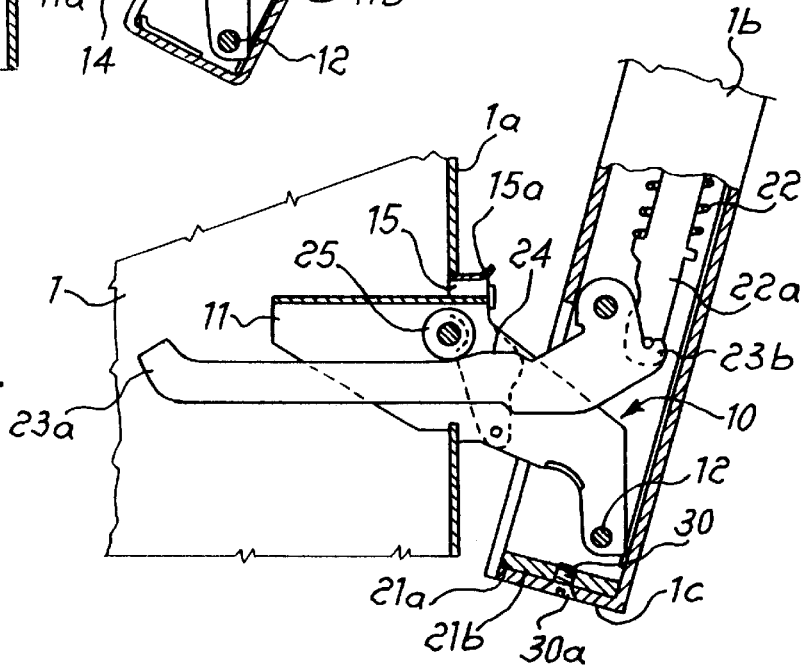
FIG. 6 shows a cross-section similar to that of FIG. 1, illustrating an example of a variant for fixing the hinge to the door in the longitudinal direction instead of the transverse direction.

Finally, and as illustrated in FIG. 6, it is also possible to provide the hinge with a base plate 21*a* for closing the body 21 of the hinge in the transverse direction; this base plate has formed in it a threaded hole 21*b* suitable for engagement with a corresponding screw 30, the head 30*a* of which reacts against the bottom surface 1*c* of the door 1*b*.

In this way it is possible to provide a fastening system with means arranged parallel to the plane of the door 1*b* and hidden from the user's sight with obvious practical advantages during assembly and aesthetic advantages during use.

In all its embodiments the hinge is also designed to prevent accidental introduction of the fingers, especially by children, between the two arms of the hinge itself.

I claim:

1. A hinge device for connecting a door to an appliance, the hinge device comprising a fixed arm pivotably mounted on the door and engageable with the body of the appliance, said fixed arm having a cross-section in the form of an upturned "U" having parallel side walls, an idle roller mounted between said side walls; a movable part, the movable part having a cavity therein, a first end and a second end, said movable part being hinged on said fixed arm; a movable arm positioned between the side walls of said fixed arm, the movable arm having a first end and a second end, the second end of the movable arm being hinged to the movable part; a support located into the cavity of the movable part and operatively associated with the second end of the movable arm; a spring mounted in the cavity of the movable part and operatively associated with the support; and means for selectively fastening the movable arm to the fixed arm.

2. A hinge device according to claim 1, wherein said first end of the movable arm is hook-shaped and adapted to engage said roller when the door is in the fully open position.

3. A hinge device according to claim 1, wherein the movable arm has an upper surface provided with a projection designed to cooperate with the roller so as to retain the door against the force exerted by the spring when the spring is stretched.

4. A hinge device according to claim 2, wherein said projection has a substantially flat upper surface and at least one inclined side.

5. A hinge device according to claim 4, wherein said flat upper surface cooperates with said roller so as to produce a recall force during closing of the door.

6. A hinge device according to claim 4, wherein said inclined side of the projection cooperates with the idle roller so as to counterbalance the thrusting action of the spring to provide a stable partially open position of the door.

7. A hinge device according to claim 1, wherein each fixed arm side wall has a bottom end, and said means for selectively fastening said movable arm and said fixed arm comprises a lever hinged on a pin arranged across the bottom ends of the fixed arm side walls.

8. A hinge device according to claim 7, wherein said lever has a free end shaped in the manner of a tongue designed to be inserted into a corresponding seat of the movable arm.

9. A hinge device according to claim 1, wherein the appliance door has a cavity defined therein and a bottom surface bounding the cavity, the hinge device further comprising a base plate adapted for mounting to the door bottom surface, said base plate having formed in it a threaded hole suitable for engagement with a corresponding screw, the head of which reacts against the bottom surface of the door.

* * * * *